US010297432B2

(12) United States Patent
Collings

(10) Patent No.: US 10,297,432 B2
(45) Date of Patent: May 21, 2019

(54) SYSTEMS AND METHODS FOR SEQUENTIAL WINDOWED ACQUISITION ACROSS A MASS RANGE USING AN ION TRAP

(71) Applicant: DH TECHNOLOGIES DEVELOPMENT PTE. LTD., Singapore (SG)

(72) Inventor: Bruce Andrew Collings, Bradford (CA)

(73) Assignee: DH Technologies Development Pte. Ltd. (SG)

( * ) Notice: Subject to any disclaimer, the term of this patent is extended or adjusted under 35 U.S.C. 154(b) by 1081 days.

(21) Appl. No.: 14/380,689

(22) PCT Filed: Mar. 15, 2013

(86) PCT No.: PCT/IB2013/000384
§ 371 (c)(1),
(2) Date: Aug. 22, 2014

(87) PCT Pub. No.: WO2013/150351
PCT Pub. Date: Oct. 10, 2013

(65) Prior Publication Data

US 2015/0025813 A1 Jan. 22, 2015

Related U.S. Application Data

(60) Provisional application No. 61/619,008, filed on Apr. 2, 2012.

(51) Int. Cl.

| | |
|---|---|
| ***H01J 49/00*** | (2006.01) |
| ***H01J 49/36*** | (2006.01) |
| ***H01J 49/42*** | (2006.01) |

(52) U.S. Cl.
CPC ..... *H01J 49/0027* (2013.01); *H01J 49/004* (2013.01); *H01J 49/0031* (2013.01); *H01J 49/36* (2013.01); *H01J 49/422* (2013.01)

(58) Field of Classification Search
CPC ..... H01J 49/004; H01J 49/145; H01J 49/427; H01J 49/025; H01J 49/0027;
(Continued)

(56) References Cited

U.S. PATENT DOCUMENTS 8,809,770 B2 8/2014 Bonner et al.
2005/0230611 A1* 10/2005 Denny ..... H01J 49/0036 250/282

(Continued)

FOREIGN PATENT DOCUMENTS

JP 02-100318 A 1/1996
WO 2010044370 A1 4/2010

(Continued)

OTHER PUBLICATIONS

International Search Report and Written Opinion for PCT/IB2013/000384, dated Aug. 27, 2013.

(Continued)

*Primary Examiner* — Regis J Betsch
*Assistant Examiner* — Kaleria Knox
(74) *Attorney, Agent, or Firm* — Josh R. Kasha; Kelly L. Kasha; Kasha Law LLC

(57) ABSTRACT

Systems and methods are provided to perform sequential windowed acquisition of mass spectrometry data. A mass range and a mass window width parameter are received for a sample. A plurality of ions from the sample that are within the mass range are collected in an ion trap of a mass spectrometer. Two or more mass adjacent or overlapping windows are calculated to span the mass range using the mass window width parameter. Ions within each mass win- (Continued)

dow are ejected from the ion trap. A mass spectrum is then detected from the ejected ions of the each mass window with a mass analyzer of the mass spectrometer, producing a collection of mass spectra for the mass range. The two or more mass windows can all have the same width, can all have different widths, or can have at least two mass windows with different widths.

20 Claims, 13 Drawing Sheets

(58) Field of Classification Search
CPC ..... H01J 49/0031; H01J 49/428; G01N 30/8624; G02B 15/177
USPC ..... 250/282, 292, 283; 435/23; 702/19
See application file for complete search history.

(56) References Cited

U.S. PATENT DOCUMENTS

2006/0038123 A1* 2/2006 Quarmby ..... H01J 49/427 250/292
2006/0066958 A1* 3/2006 Take ..... G02B 15/177 359/692
2006/0080040 A1* 4/2006 Garczarek ..... G01N 30/8624 702/19
2006/0284080 A1 12/2006 Makarov et al.
2008/0142706 A1* 6/2008 Michelmann ..... H01J 49/025 250/292
2008/0185511 A1 8/2008 Senko
2010/0059673 A1* 3/2010 Makarov ..... H01J 49/0031 250/283
2010/0084547 A1* 4/2010 Pringle ..... H01J 49/428 250/282
2010/0237237 A1 9/2010 Green et al.
2010/0280764 A1 11/2010 Thomson et al.
2011/0127419 A1* 6/2011 Thomson ..... H01J 49/004 250/282
2011/0248162 A1 10/2011 Makarov et al.
2012/0156707 A1* 6/2012 Hartmer ..... H01J 49/145 435/23

FOREIGN PATENT DOCUMENTS

WO 2011026228 A1 3/2011
WO 2012035412 A2 3/2012

OTHER PUBLICATIONS

Carvalho et al. "XDIA: Improving on the Label-Free Data-Independent Analysis" Bioinformatics, vol. 26, No. 6, Jan. 26, 2010.
Gillet et al. "Targeted Data Extraction of the MS/MS Spectra Generated by Data-Independent Acquisition: A New Concept for Consistent and Accurate Proteome Analysis." Molecular & Cellular Proteomics, vol. 11, No. 6, Jan. 18, 2012.

* cited by examiner

100

| | 400 Da | 425 Da | 1175 Da | 1200 Da |
|---|---|---|---|---|
| **Mathieu q** | 0.714682 | 0.672642 | 0.709844 | **0.695055** |
| **beta** | 0.579454 | 0.533796 | 0.573996 | **0.557660** |
| **Secular Frequency (Hz)** | 355,925 | 327,880 | 352,572 | **342,538** |
| **Frequency range (Hz)** | **28,045** | | **10,034** | |

400

500

600

700

800

900

1000

1100

SYSTEMS AND METHODS FOR SEQUENTIAL WINDOWED ACQUISITION ACROSS A MASS RANGE USING AN ION TRAP

CROSS REFERENCE TO RELATED APPLICATION

This application claims the benefit of U.S. Provisional Patent Application Ser. No. 61/619,008, filed Apr. 2, 2012, the content of which is incorporated by reference herein in its entirety.

INTRODUCTION

Recently developed high-resolution and high-throughput quadrupole mass spectrometry instruments allow a mass range to be accurately scanned within a small time interval of a separation experiment using multiple scans with adjacent or overlapping mass windows. Results from the multiple scans can be pieced together to produce a spectrum for the entire mass range at each time interval. The collection of each spectrum at each time interval of the separation is a collection of spectra for the entire mass range. A method for using windowed mass spectrometry scans to scan an entire mass range is called sequential windowed acquisition or sequential windowed acquisition through libraries (SWATH), for example.

In one exemplary sequential windowed acquisition experiment, a mass range of 400 to 1200 Daltons (Da) was divided into 32 adjacent 25 Dalton (Da) mass windows. A spectrum was accumulated for 100 milliseconds (ms) for each mass window using a quadrupole time-of-flight (TOF) mass spectrometer. The total time for the accumulation of a mass spectrum for the mass range was 3.2 seconds. In other words, the minimum time interval for the separation experiment was 3.2 seconds.

The duty cycle or efficiency of a sequential windowed acquisition experiment is limited by the amount of time that is required to collect a TOF spectrum for a mass window that has the appropriate signal-to-noise ratio. Although recently developed high-resolution and high-throughput quadrupole time-of-flight mass spectrometry instruments have significantly increased the duty cycle, quadrupole time-of-flight mass spectrometry still has a number of limitations. For example, the selection of each mass window involves a mass filtering step that is typically time consuming. In addition, the mass filtering step requires that a number of ions be wasted. As a result, if the ion flux from the source is low there may not be enough ions to obtain a spectrum with the desired signal-to-noise ratio for the entire mass range.

BRIEF DESCRIPTION OF THE DRAWINGS

The skilled artisan will understand that the drawings, described below, are for illustration purposes only. The drawings are not intended to limit the scope of the present teachings in any way.

Figure 1:
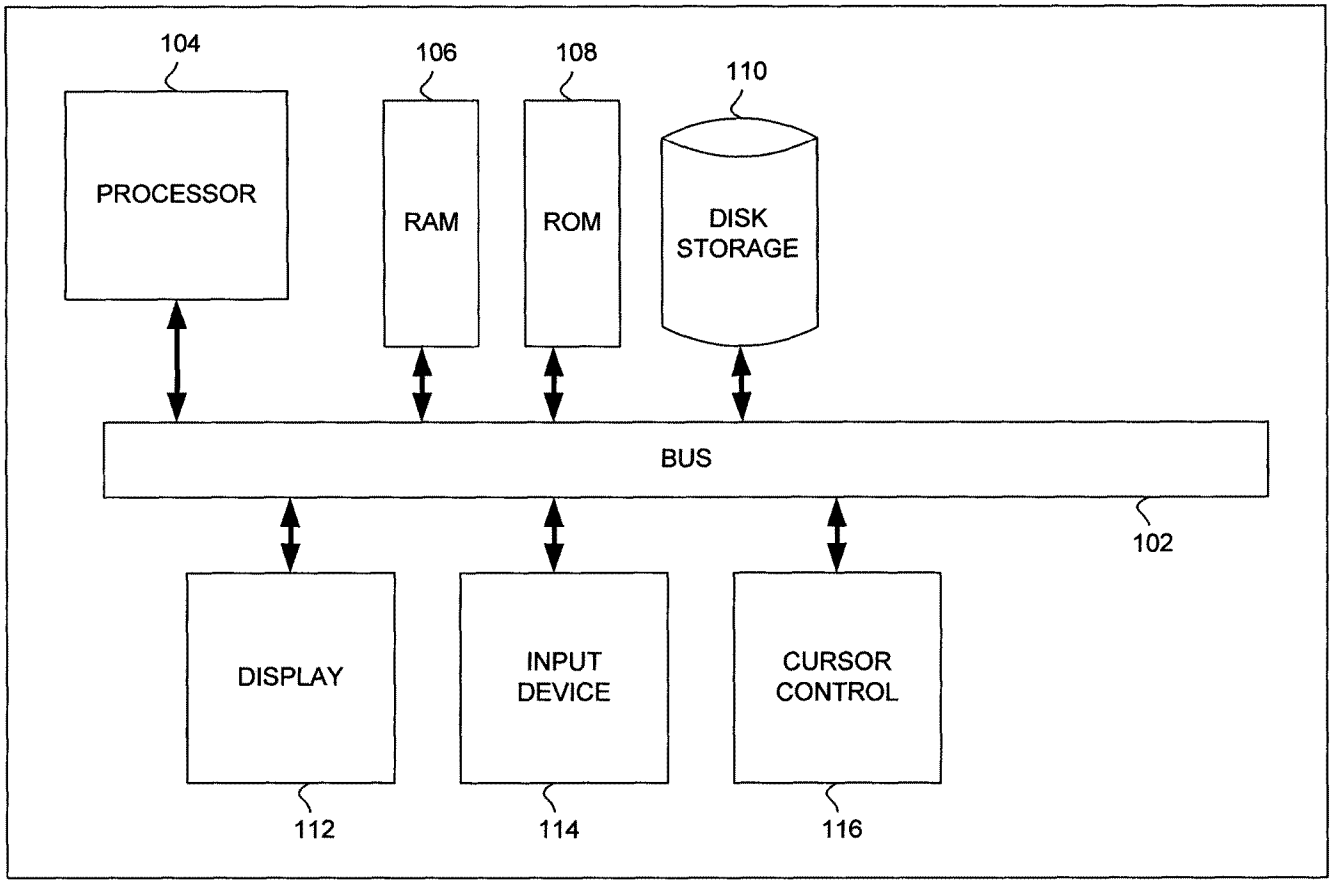
FIG. 1 is a block diagram that illustrates a computer system, in accordance with various embodiments.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Sequential Windowed Acquisition Using an Ion Trap

As described above, recently developed high-resolution and high-throughput quadrupole time-of-flight mass spectrometry instruments allow a mass range to be accurately scanned within a small time interval of a separation experiment using multiple scans with adjacent or overlapping mass windows. In one exemplary sequential windowed acquisition experiment, a mass range of 400 to 1200 Daltons (Da) was divided into 32 adjacent 25 Dalton (Da) mass windows. A spectrum was accumulated for 100 milliseconds (ms) for each mass window. The total time for the accumulation of a mass spectrum for the entire mass range was, therefore, 3.2 seconds.

Although these recently developed high-resolution and high-throughput quadrupole time-of-flight mass spectrometry instruments have made sequential windowed acquisition possible, they still have a number of limitations. For example, the selection of each mass window involves a mass filtering step that is typically time consuming. In addition, the mass filtering step requires that a number of ions be wasted. As a result, if the ion flux from the source is low, there may not be enough ions to obtain a spectrum with the desired signal-to-noise ratio for the entire mass range.

In various embodiments, sequential windowed acquisition is performed using an ion trap. By using an ion trap, the time consuming mass filtering step is performed only once. Selection of mass windows is performed by the faster step of ejecting ions from the ion trap.

Consider the example mentioned above. An ion trap can be filled with all the ions from a mass range of 400 to 1200 Da in 111 ms, for example. This is the one mass filtering step. Each ejection of a 25 Da mass window of ions from the ion trap can be performed in 10 ms, for example. As a result, the total time for sequential windowed acquisition using an ion trap is $100+32\times18$ or 699 ms. This means that the duty cycle of sequential windowed acquisition using an ion trap is almost five times faster than the duty cycle of sequential windowed acquisition using a quadrupole time-of-flight, for example.

In various embodiments, an ion trap is used to collect ions within a mass range and to selectively eject the collected ions using two or more adjacent or overlapping mass windows that span a mass range. A method for selective axial transport of ions in a linear ion trap (LIT) mass spectrometer is described in U.S. Pat. No. 7,459,679 (hereinafter the "'679 patent"), for example. In the '679 patent, groups of ions having different mass-to-charge ratios are admitted into the LIT. A first group of ions having a first mass-to-charge ratio (m/z) is selected using a first radial excitement field and then ejected using an axial acceleration field. Subsequent to the ejection of the first group of ions, a second group of ions is ejected in the same manner. The m/z range of the first group of ions is disjoint from the m/z range of the second group of ions.

The '679 patent, therefore, describes ejecting groups of ions having different and disjoint m/z ranges at different times. Disjoint m/z ranges are m/z ranges that do not share a single m/z value or are m/z ranges that are not joined or adjacent, for example. The '679 patent, therefore, does not suggest that the different m/z ranges of the ejected groups are selected to scan a continuous mass range of the ions admitted to the LIT. In other words, the '679 patent does not describe sequential windowed acquisition.

A goal of sequential windowed acquisition is, for example, to quantify all species in a large mass range with the selectivity and specificity of a multiple reaction monitoring (MRM) experiment within a single analysis. Sequential windowed acquisition is, therefore, well suited for tandem mass spectrometry (MS/MS). The ions selected in the different mass windows can be transferred to a collision cell for MS/MS fragmentation.

In various embodiments, the ion trap used for sequential windowed acquisition is a LIT. This LIT is similar to the LIT described in the '679 patent, for example. The LIT is used to collect ions within a large mass range, for example. A calculated amount of resolving direct current (DC) is applied to allow transmission of only those ions within the mass range. The LIT has the ability to selectively excite a trapped ion and then give it an axial push for ejection. This technique is called, for example, radial amplitude assisted transfer (RAAT).

A wide mass range of ions can be excited in a RAAT trap by using a broadband excitation waveform, such as a filtered noise field (FNF). This allows a number of ions to be excited at the same time and then sent through a collision cell for MS/MS. Once the data for a first mass window has been collected, the next adjacent or overlapping mass window, from the same filling of the LIT, is then ejected from the LIT to collect the next spectrum. This process is repeated until the entire mass range of the initial large mass range window has been covered.

In various embodiments, the two or more mass windows that are used to eject ions and that span the mass range have the same mass width and are selected using variable excitation frequency ranges. For example, a LIT is instructed to transmit a mass range of ions from 400 to 1200 Da. This requires 196.28 V of resolving DC with the LIT set to mass 854.7 m/z (calibration q=0.7045, drive frequency=1.228484 MHz, $r_0$=4.17 mm). The ions are trapped and cooled in a collision cell. The entire mass range is then transferred back to the LIT. It is known that ions trapped with the same radio frequency (RF) amplitude have Mathieu q values defined by $$q = \frac{4\ \text{eV}}{m r_0^2 \Omega^2} \tag{1}$$

where m is the mass of the ion, V is the RF amplitude, $r_0$ is the field radius of the LIT, and Ω is the angular drive frequency. Each ion has its own fundamental frequency of motion defined by $$\omega_0 = \beta \frac{\Omega}{2} \tag{2}$$

where β is a function of q. The parameter β is calculated using the continued fraction expression, for example.

A first mass window to be ejected out of the LIT is from 400 to 425 Da, if uniform 25 Da windows are chosen. The mass at the center of that range (412.5 Da) can be set at a known q value (i.e. the LIT has a calibration q of 0.7045 and the drive frequency is 1.228 484 MHz). This means that 400 Da resides at q=0.714682 while 425 Da resides at q=0.672642 with all other masses having q values ranging between those values. The q values are calculated using $$m_1 q_1 = m_2 q_2 \tag{3}$$

which is derived using equation (1), for example.

The first mass window, therefore, requires a range of excitation frequencies from 355,925 Hz to 327,880 Hz. The last mass window, 1175 to 1200 Da, requires a different range of excitation frequencies, however, and this range is decreased.

Figure 2:
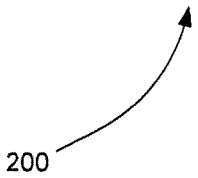
FIG. 2 is an exemplary table that shows how the range of excitation frequencies decreases from the first mass window to the last mass window of two or more adjacent or overlapping mass windows that span a mass range, if each mass window of the two or more mass windows has the same mass width, in accordance with various embodiments.

FIG. 2 is an exemplary table 200 that shows how the range of excitation frequencies decreases from the first mass window to the last mass window of two or more adjacent or overlapping mass windows that span a mass range, if each mass window of the two or more mass windows has the same mass width, in accordance with various embodiments. The decrease in the range of excitation frequencies is due to the fact that as the mass increases, the difference between q values calculated for two masses separated by 25 Da decreases.

In various alternative embodiments, the two or more mass windows that are used to eject ions and that span the mass range have different mass widths and are selected using the same excitation frequency range. The frequency range is held constant and the mass window width is increased with increasing mass, for example. If the first mass window starts with a 25 Da (28,045 Hz) window width centered at 412.5 Da, then the last mass window that reaches 1200 Da has a mass width from 1129 to 1200 Da, or 71 Da, if the same excitation frequency range or waveform is used.

In still further various embodiments, the excitation frequency range is kept constant for a fraction of the mass range and then adjusted part way through the mass range. For example, the mass range 400 to 1200 Da is split into two ranges: 400 to 800 Da and 800 to 1200 Da. The first range uses an excitation frequency range based on the mass window 400 to 425 Da while the second range would reset the frequency range to correspond to a 25 Da window ranging from 800 to 825 Da. In this fashion the mass windows in first mass range vary from 25 Da (400 to 425 Da) up to 47.1 Da (752.9 to 800 Da). In the second mass range the mass windows vary from 25 Da (800 (q=0.715508) to 825 (q=0.693826) Da) to 36.4 Da (1163.6 to 1200 Da).

Allowing the mass widths of the different mass windows to vary instead of the excitation frequency range means the same waveform can be used for a number of windows. If the mass window is kept constant at a width of 25 Da then it is necessary to either re-construct the waveform each time or at least have a number of waveforms constructed and stored beforehand. The waveforms can be constructed using any standard technique for filtered noise fields.

In various embodiments, a RAAT LIT is used for sequential windowed acquisition. A radial excitement field is used to selected ions in each of the two or more mass windows and the ion are then ejected using an axial acceleration field.

In various alternative embodiments, ions from two or more mass windows are ejected from a LIT using mass selective axial ejection (MSAE). This technique is similar to RAAT, except that an axial field is not applied. Instead, the exit barrier is lowered in order to eject the ions of each mass window. For example, the exit barrier is lowered to a few volts or less. The excitation amplitudes are also decreased and the excitation periods are increased (at least a few tens of milliseconds).

Data Examples

Figure 3:
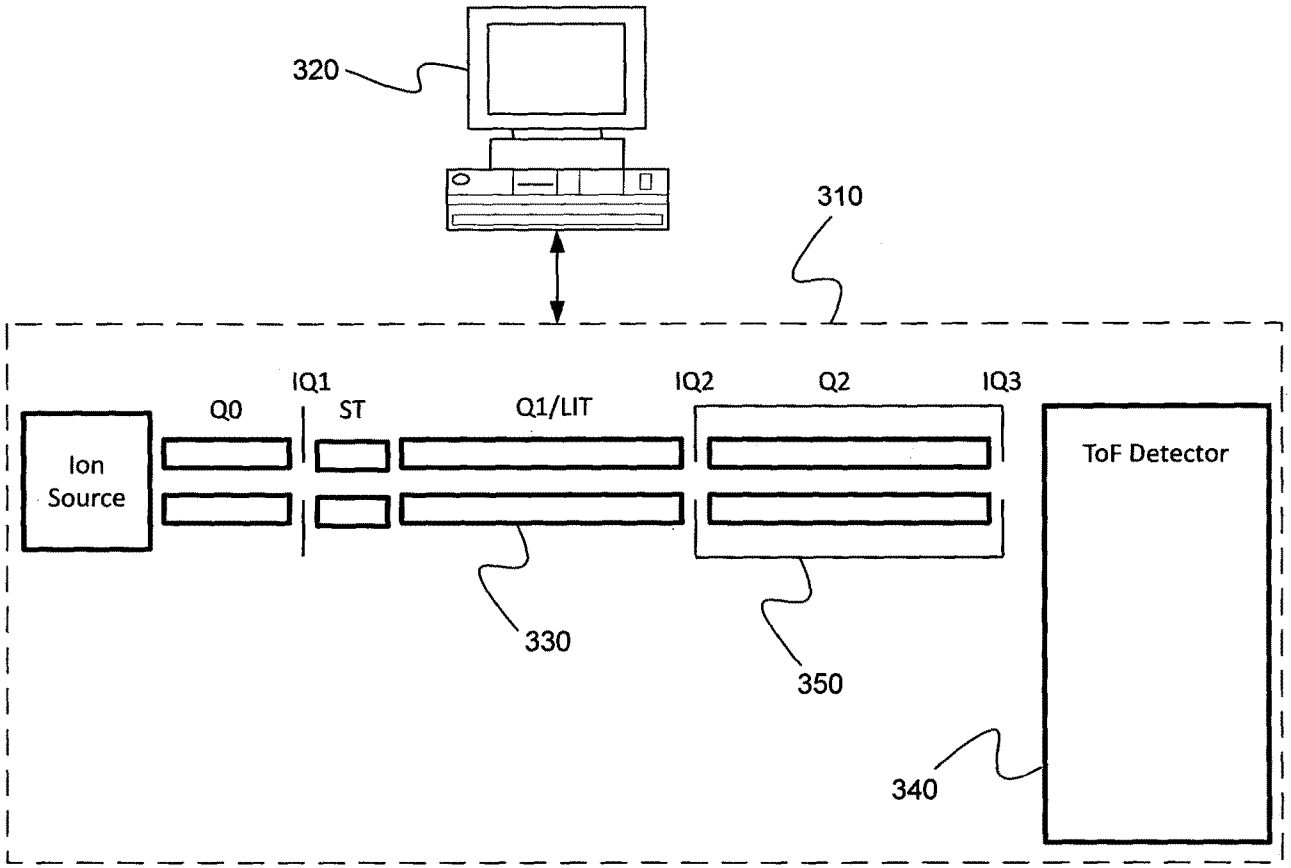
FIG. 3 is a schematic diagram of a mass spectrometry system for sequential windowed acquisition, in accordance with various embodiments.

FIG. 3 is a schematic diagram of a mass spectrometry system 300 for sequential windowed acquisition, in accordance with various embodiments. System 300 includes mass spectrometer 310 and processor 320. Processor 320 is in communication with mass spectrometer 310. Processor 320 can be, but is not limited to, a computer, microprocessor, or any device capable of sending and receiving control signals and data to and from mass spectrometer 310 and processing data. Processor 320 instructs mass spectrometer 310 to perform a tandem mass spectrometry or MS/MS sequential windowed acquisition using a number of steps, for example.

In step 1, mass spectrometer 310 collects time-of-flight (TOF) mass spectrometry (MS) data for a sample. This is MS data collected in 100 ms, for example. A mass range of the MS data is selected for MS/MS.

In step 2, the radio frequency direct current (RFDC) component window is set on Q1 of mass spectrometer 310 in order to select ions in the mass range. This setting is applied in 1 ms, for example.

In step 3, Q2 of mass spectrometer 310 is filled with ions in the mass range and the ions are allowed to cool. The transfer and cooling of ions takes between 1 and 100 ms, for example. At the same time IQ1 and ST of mass spectrometer 310 are raised after the transfer of ions to Q2 in order to turn off the ion beam.

Figure 4:
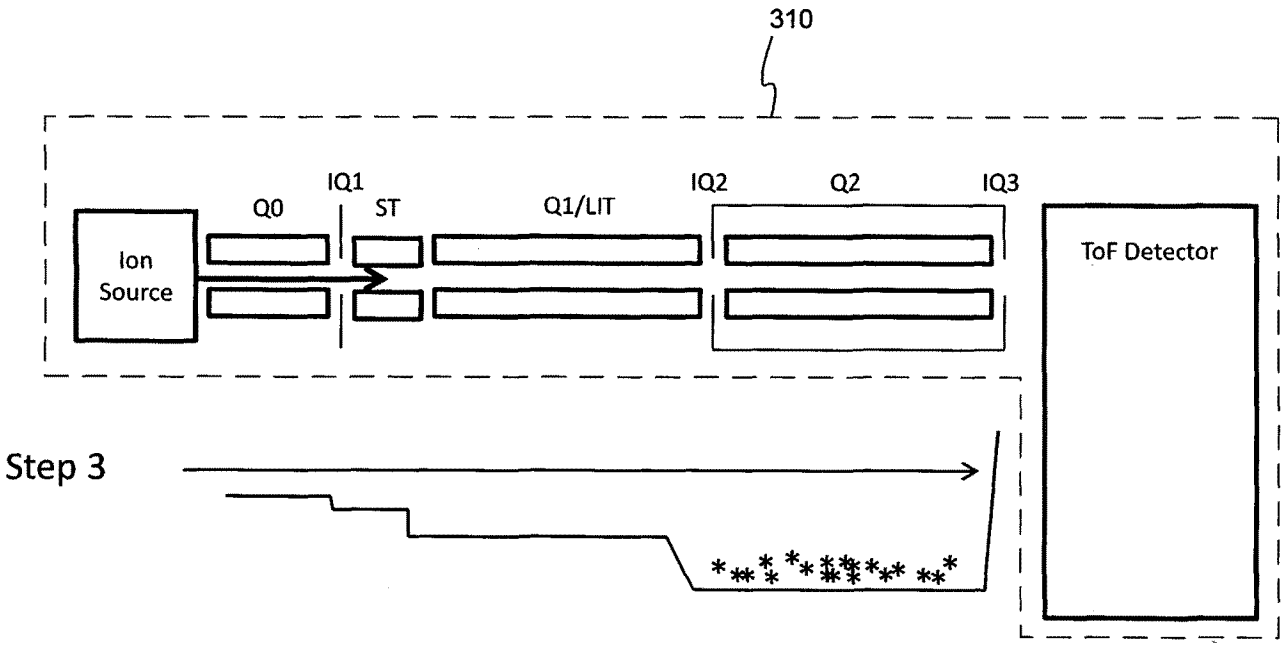
FIG. 4 is a schematic diagram depicting the location of the ions of the selected mass range after step 3 of the mass spectrometry/mass spectrometry (MS/MS) sequential windowed acquisition, in accordance with various embodiments.

FIG. 4 is a schematic diagram depicting the location 400 of the ions of the selected mass range after step 3 of the MS/MS sequential windowed acquisition, in accordance with various embodiments.

In step 4, the ions in the selected mass range are transferred back to Q1 of mass spectrometer 310. Q1 is a LIT/RAAT, for example. The ions are transferred in 10 ms, for example.

Figure 5:
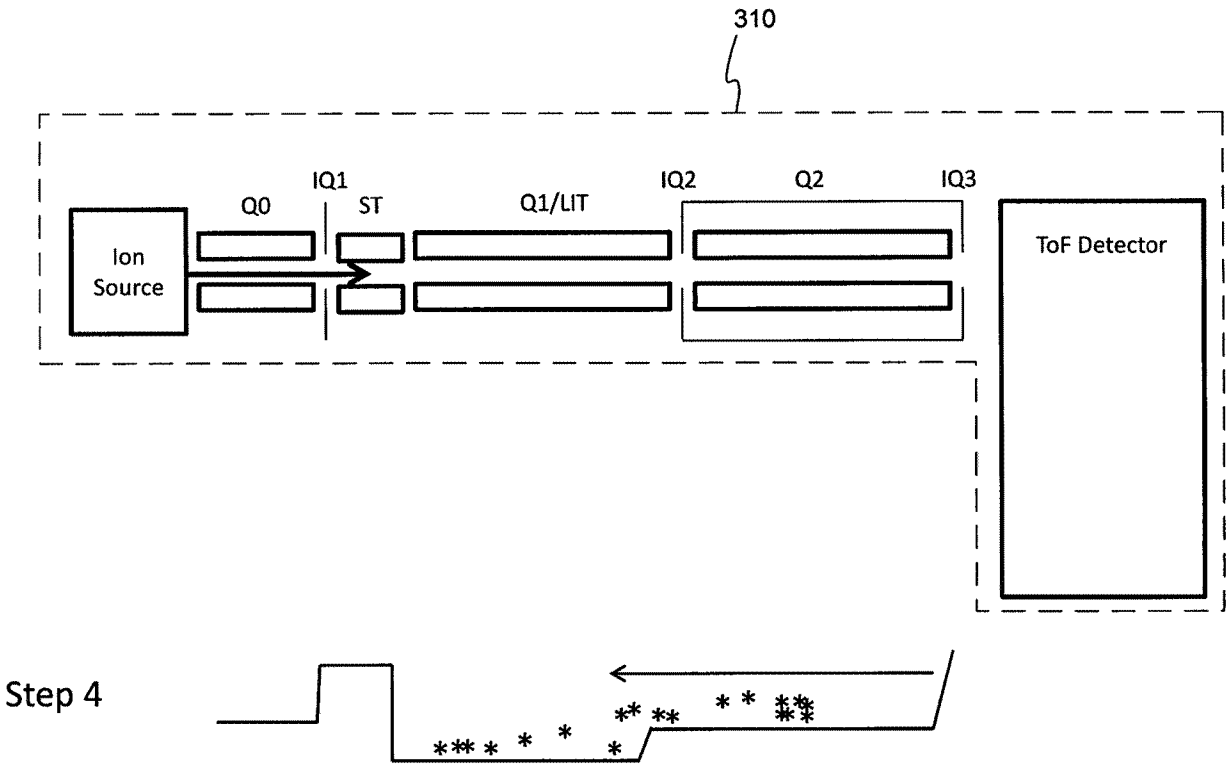
FIG. 5 is a schematic diagram depicting the location of the ions of the selected mass range during step 4 of the MS/MS sequential windowed acquisition, in accordance with various embodiments.

FIG. 5 is a schematic diagram depicting the location 500 of the ions of the selected mass range during step 4 of the MS/MS sequential windowed acquisition, in accordance with various embodiments.

In step 5, the RF amplitude on Q1 of mass spectrometer 310 is adjusted to an appropriate level for the application of an excitation waveform to select ions of a mass window for MS/MS. The DC offset of Q2 of mass spectrometer 310 is adjusted to give a desired collision energy, and IQ3 is also adjusted. IQ3 is raised to provide a barrier for the trapping of ions in the Q2 collision cell. These adjustments are performed in 1 ms, for example.

Figure 6:
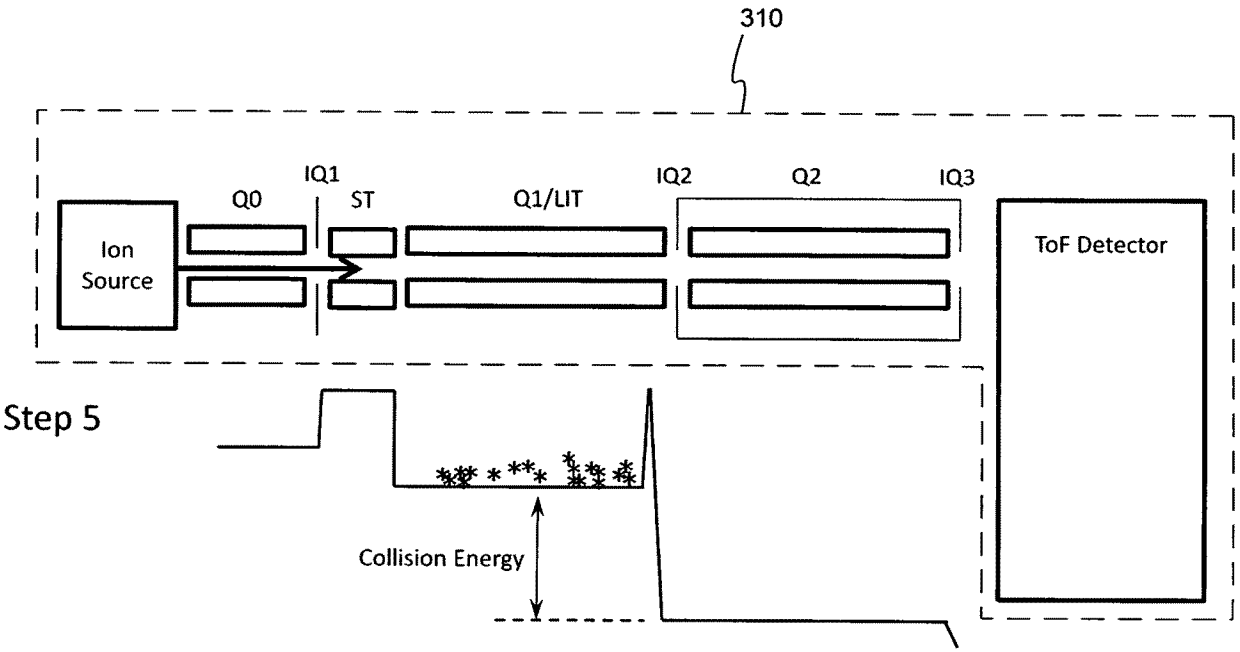
FIG. 6 is a schematic diagram depicting the location of the ions of the selected mass range after step 5 of the MS/MS sequential windowed acquisition, in accordance with various embodiments.

FIG. 6 is a schematic diagram depicting the location 600 of the ions of the selected mass range after step 5 of the MS/MS sequential windowed acquisition, in accordance with various embodiments.

In step 6, the ions of the selected mass window are excited to a high radial amplitude. The ions are excited in 5 ms, for example.

Figure 7:
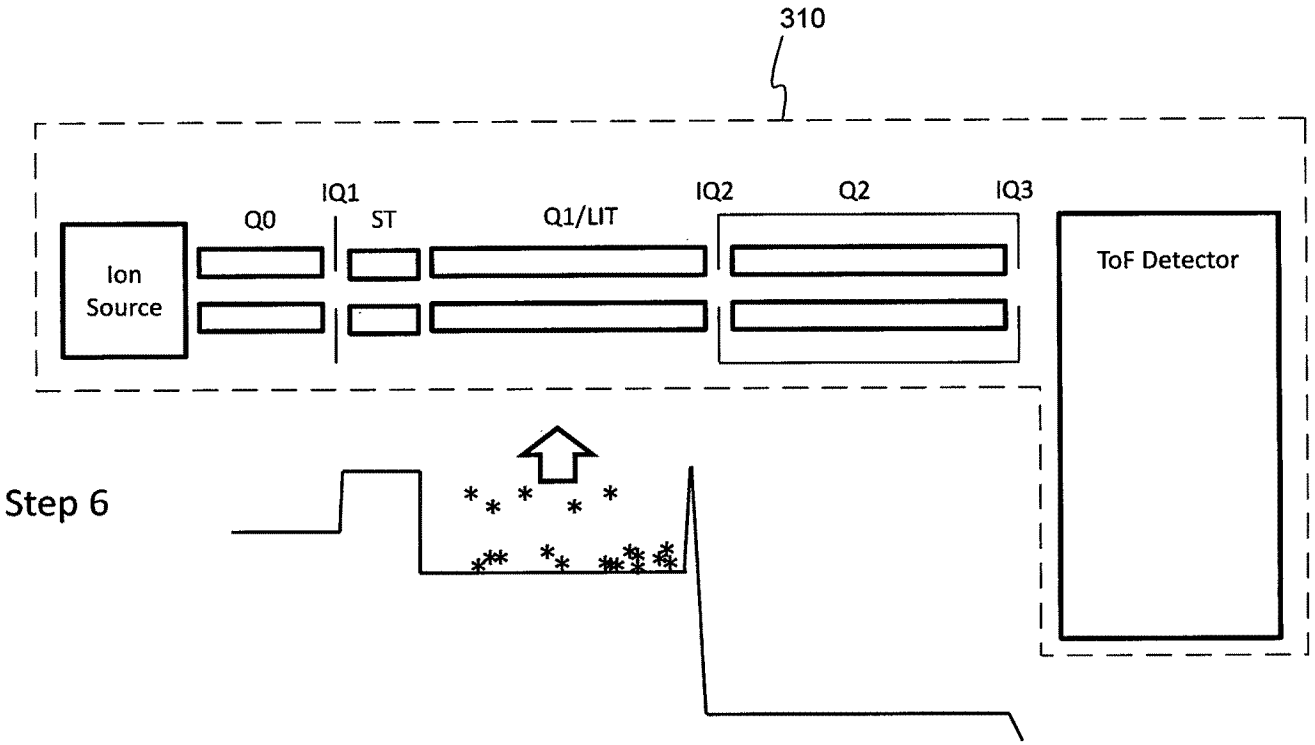
FIG. 7 is a schematic diagram depicting the location of the ions of the selected mass range after step 6 of the MS/MS sequential windowed acquisition, in accordance with various embodiments.

FIG. 7 is a schematic diagram depicting the location 700 of the ions of the selected mass range after step 6 of the MS/MS sequential windowed acquisition, in accordance with various embodiments.

In step 7, radial excitation is turned off and IQ2 of mass spectrometer 310 is adjusted to a desired level. These changes are made in 1 ms, for example.

In step 8, an axial field is turned on to eject the ions of the selected mass window from Q1 of mass spectrometer 310. Only those ions that are excited in step 6 to a higher radial amplitude feel the force of the pulsed axial field. The ions are sent to Q2 of mass spectrometer 310 where they are fragmented through high energy collisions. Q2 is a collision cell, for example. Step 8 is performed in 1 ms, for example.

Figure 8:
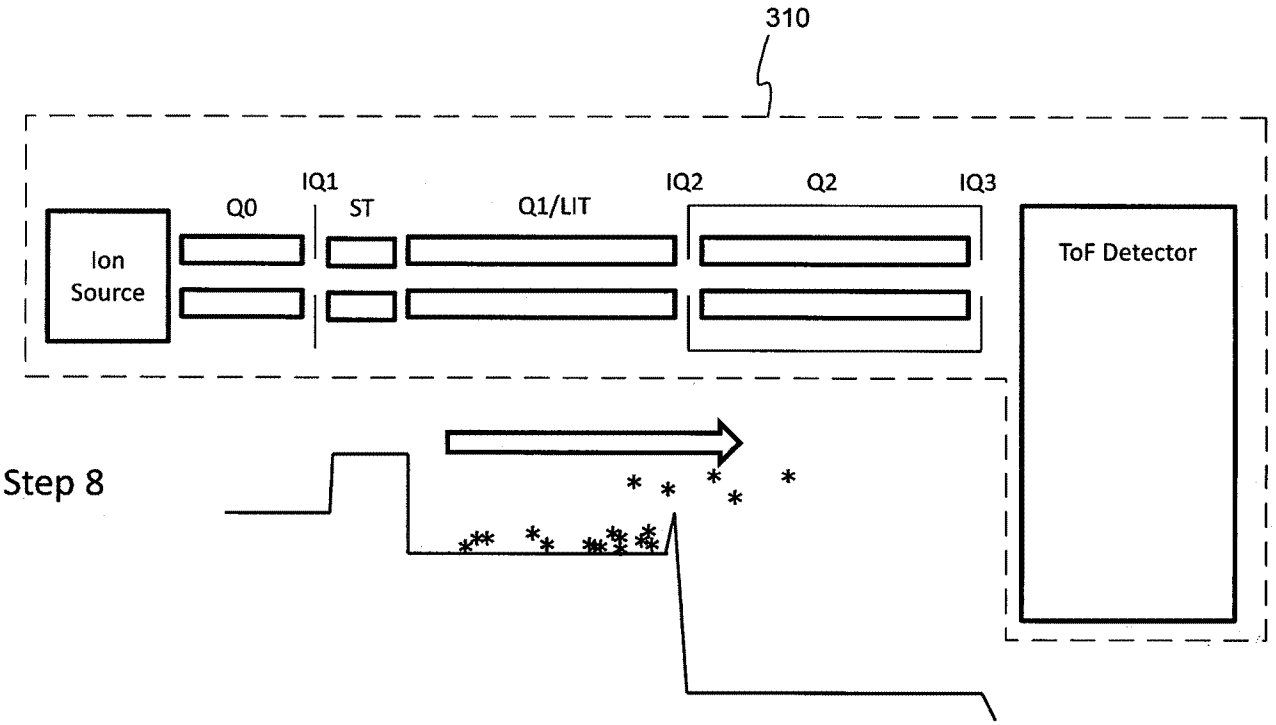
FIG. 8 is a schematic diagram depicting the location of the ions of the selected mass range during step 8 of the MS/MS sequential windowed acquisition, in accordance with various embodiments.

FIG. 8 is a schematic diagram depicting the location 800 of the ions of the selected mass range during step 8 of the MS/MS sequential windowed acquisition, in accordance with various embodiments.

In step 9, TOF MS/MS data is collected for the ions of the selected mass window. The data is collected in 10 ms, for example.

Figure 9:
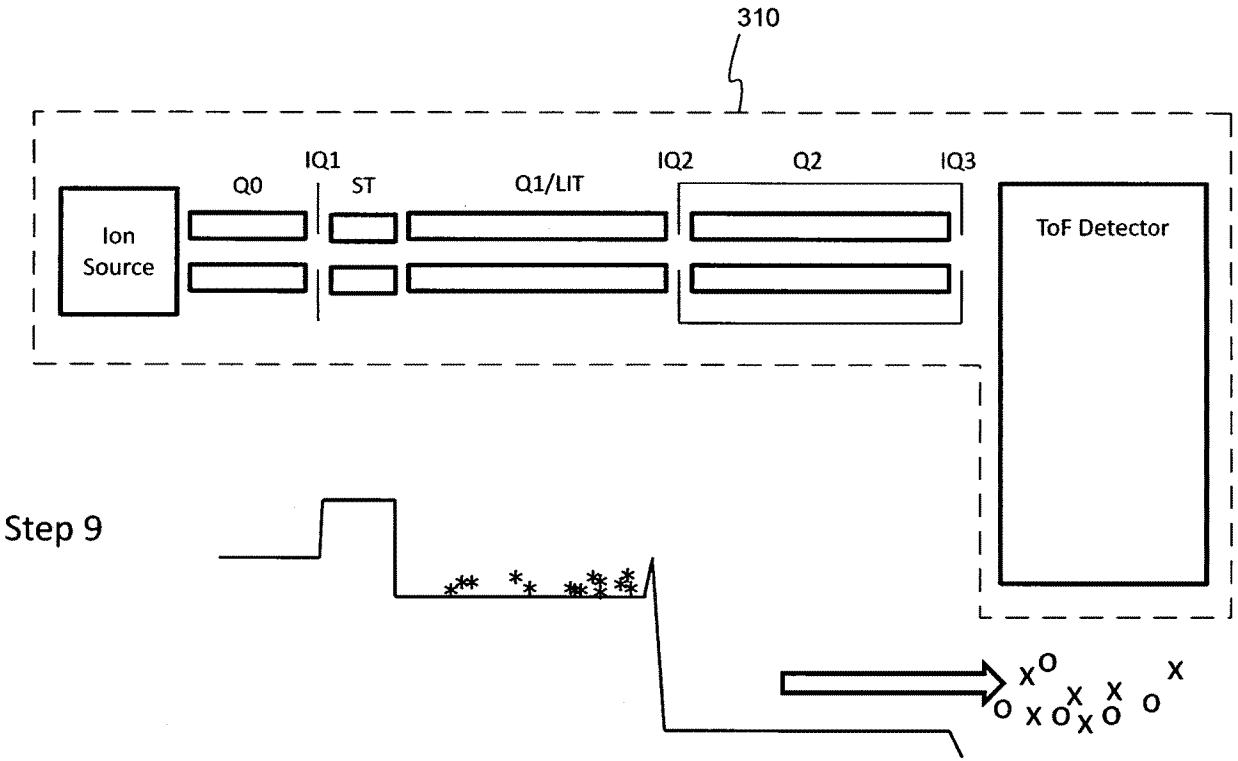
FIG. 9 is a schematic diagram depicting the location of the ions in an accelerator region of the time-of-flight section of a mass spectrometer during the MS/MS sequential windowed acquisition, in accordance with various embodiments.

FIG. 9 is a schematic diagram depicting the location 900 of the ions in an accelerator region (not shown) of the time-of-flight section of a mass spectrometer during the MS/MS sequential windowed acquisition, in accordance with various embodiments.

Steps 5-9 are repeated until data is collected for all ions of the mass windows that span the selected mass range. Steps 2-4 require between 12 and 111 ms, for example. Each repeat of steps 5-9 requires 18 ms, for example.

If the mass range selected in step 2 is between 400 and 1200 Da, and each mass width excited in step 6 is 25 Da, then, as above, there are a total of (1200-400)/25 or 32 total mass windows that span the 800 Da mass range. Steps 5-9 are then repeated 32 times and the total iteration requires 32×18 or 576 ms. The total time to collect MS/MS spectra is the sum of steps 2-9, which is 12 ms+576 ms=588 ms to 111 ms+576 ms=699 ms.

As described above, a quadrupole time-of-flight mass spectrometer requires about 3.2 s to collect the same MS/MS spectra. Therefore, MS/MS sequential windowed acquisition with an ion trap time-of-flight mass spectrometer is approximately 5 times faster than MS/MS sequential windowed acquisition with triple quadrupole. Also, the improvement of the duty cycle using an ion trap in comparison to quadrupole time-of-flight mass spectrometer increases nonlinearly as the mass widths of the two or more mass windows are decreased.

As described above, the two or more mass windows selected in step 6 and used to span the mass range selected in step 2 can have uniform mass widths. Alternatively, the two or more mass windows selected in step 6 can have varying mass widths.

Figure 10:
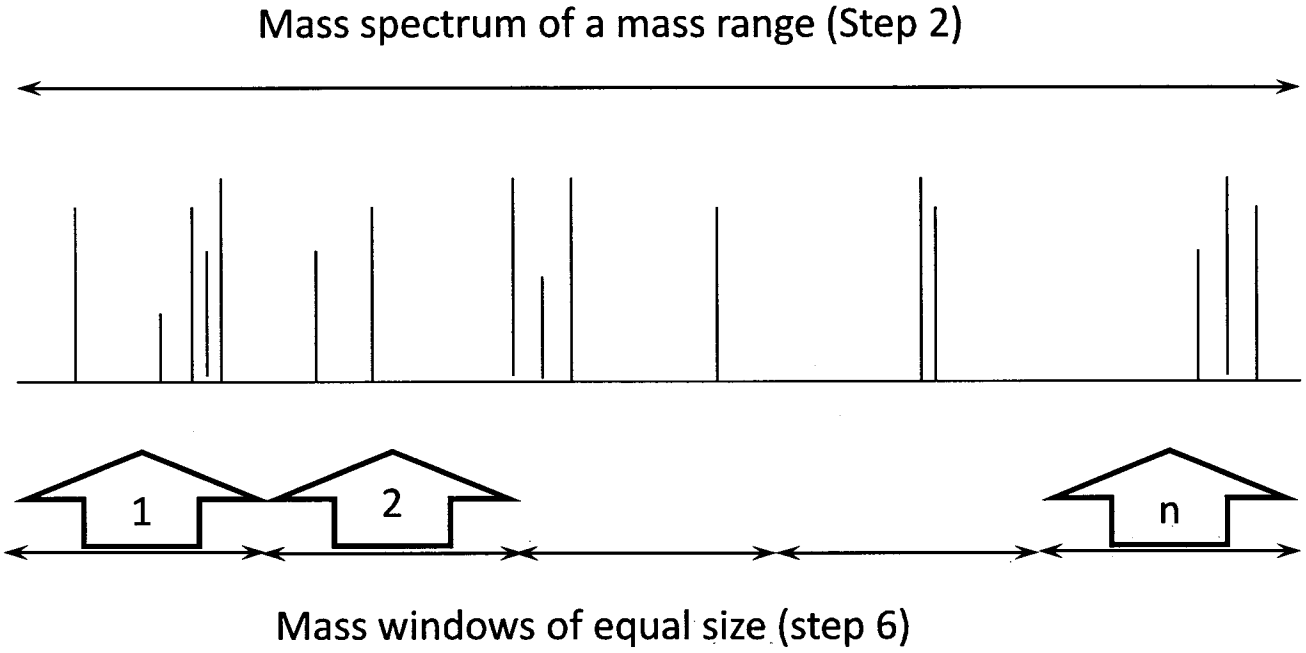
FIG. 10 is exemplary diagram depicting n mass windows that span a mass range and have uniform mass widths, in accordance with various embodiments.

FIG. 10 is exemplary diagram 1000 depicting n mass windows that span a mass range and have uniform mass widths, in accordance with various embodiments.

Figure 11:
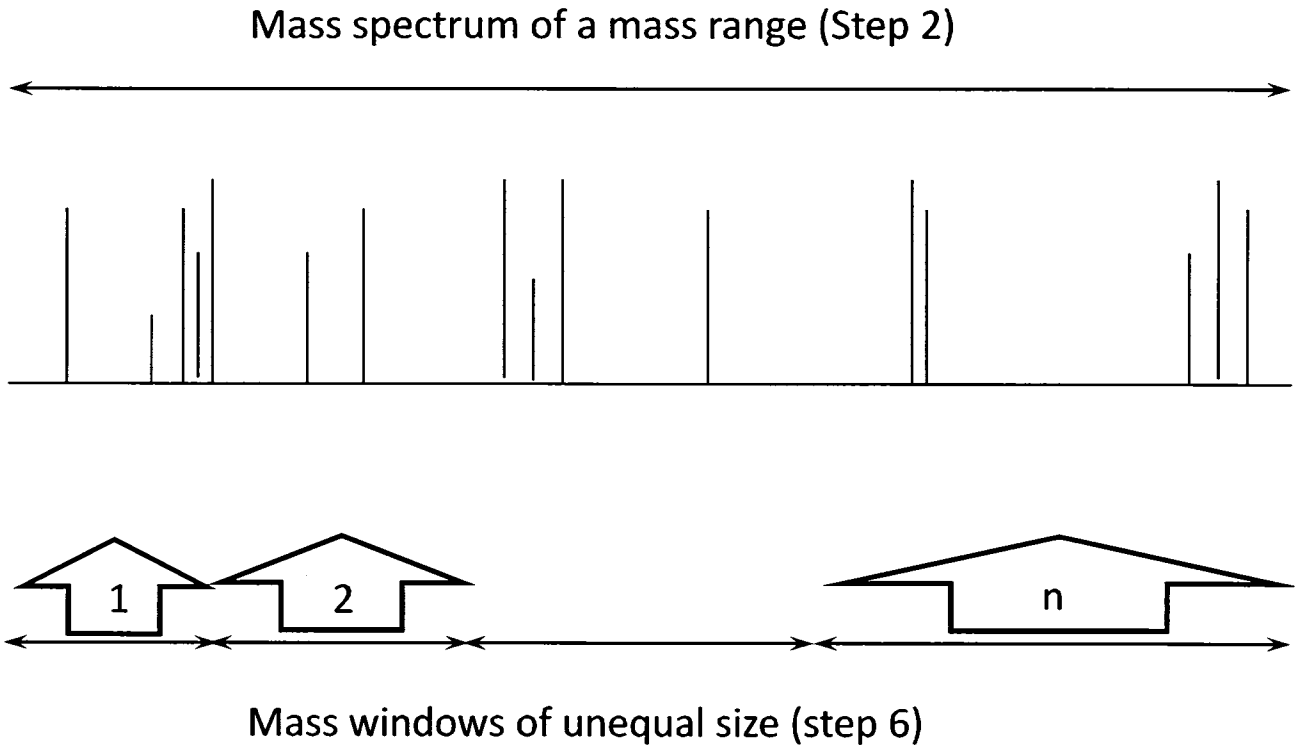
FIG. 11 is exemplary diagram depicting n mass windows that span a mass range and have variable mass widths, in accordance with various embodiments.

FIG. 11 is exemplary diagram 1100 depicting n mass windows that span a mass range and have variable mass widths, in accordance with various embodiments.

Systems and Methods of Data Processing

Sequential Windowed Acquisition System

Returning to FIG. 3, system 300 includes mass spectrometer 310 and processor 320. Mass spectrometer 310 includes ion trap 330, mass analyzer 340, and collision cell 350. Ion trap 330 is shown as a LIT. Ion trap 330, however, can be any type of ion trap. Other types of ion traps can include, but are not limited to, 3-D ion traps, toroidal ion traps, and electrostatic ion traps. Mass analyzer 340 is shown as a TOF mass analyzer. Similarly, mass analyzer 340 can be any type of mass analyzer. Other types of mass analyzers can include, but are not limited to, linear ion traps, 3-D ion traps, electrostatic ion traps, or penning ion traps. Collision cell 350 is shown as a quadrupole. Similarly, collision cell 350 can be any type of collision cell.

Processor 320 receives a mass range and a mass window width parameter for a sample. Processor 320 instructs mass spectrometer 310 to collect in ion trap 330 a plurality of ions from the sample that are within the mass range. Processor 320 calculates two or more adjacent or overlapping mass windows that span a mass range using the mass window width parameter. In other words, the two or more mass windows are joined or overlap by at least one m/z value in order to span the mass range. The mass window width parameter can include, but is not limited to, a width, a number of mass windows, or a function describing how mass window widths varying with mass.

Processor 320 instructs mass spectrometer 310 to eject ions within each mass window of the two or more mass windows from ion trap 330. Processor 320 also instructs mass spectrometer 310 to detect a mass spectrum from the ejected ions of the each mass window with mass analyzer 340, producing a collection of mass spectra for the mass range. Each mass window of the two or more mass windows is then selected and analyzed sequentially, for example. Ion trap 330 can eject the ions within each mass window of the two or more mass windows either simultaneously or sequentially, for example.

As described above, the two or more mass windows can all have the same width, can all have different widths, or can have at least two mass windows with different widths. In various embodiments and if the two or more mass windows all have the same width, processor 320 then calculates a different waveform with a different excitation frequency range for each mass window of the two or more mass windows. A different waveform is then used to eject ions within each mass window of the two or more mass windows from ion trap 330. In various embodiments, Processor 320 stores a different waveform with a different excitation frequency range for each mass window of the two or more mass windows on mass spectrometer 310 before mass spectrometer 310 ejects any ions from ion trap 330 in order to improve throughput speed.

In various embodiments and if the two or more mass windows all have different widths, then processor 320 calculates the same waveform with the same excitation frequency range for each mass window of the two or more mass windows. The same waveform is then used to eject ions within each mass window of the two or more mass windows from ion trap 330.

In various embodiments, the width of each mass window of the two or more mass windows can vary as a function of the mass range. For example, the width of each mass window of the two or more mass windows increases with increasing mass of the each mass window in the mass range.

In various embodiments, system 300 can perform tandem mass spectrometry or MS/MS. For example, processor 320 further instructs mass spectrometer 310 to fragment the ejected ions of the each mass window in collision cell 350 before detecting the mass spectrum. A collection of tandem mass spectrometry mass spectra is then produced for the mass range.

Sequential Windowed Acquisition Method

Figure 12:
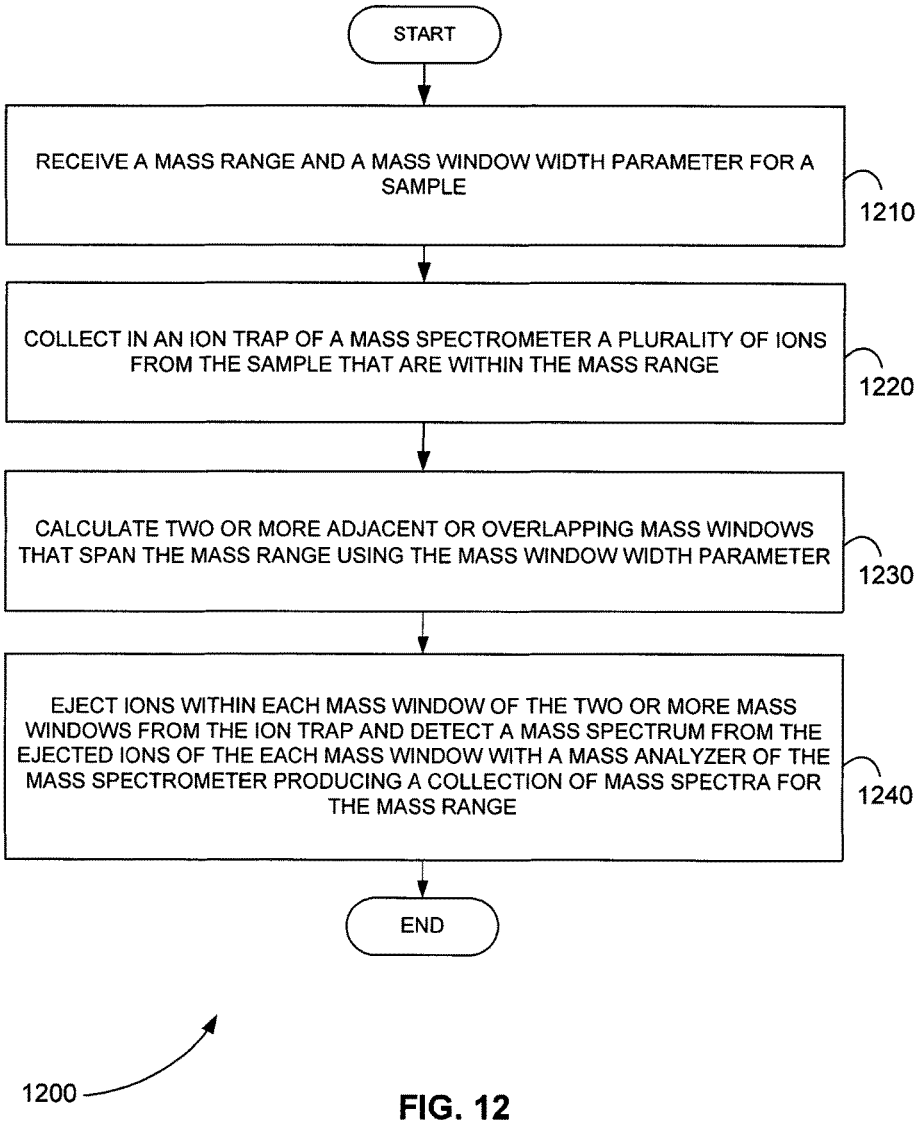
FIG. 12 is an exemplary flowchart showing a method for sequential windowed acquisition of mass spectrometry data, in accordance with various embodiments.

FIG. 12 is an exemplary flowchart showing a method 1200 for sequential windowed acquisition of mass spectrometry data, in accordance with various embodiments.

In step 1210 of method 1200, a mass range and a mass window width parameter are received for a sample.

In step 1220, a plurality of ions from the sample that are within the mass range are collected in an ion trap of a mass spectrometer.

In step 1230, two or more mass adjacent or overlapping windows are calculated that span the mass range using the mass window width parameter.

In step 1240, ions within each mass window of the two or more mass windows are ejected from the ion trap. A mass spectrum is then detected from the ejected ions of the each mass window with a mass analyzer of the mass spectrometer producing a collection of mass spectra for the mass range.

Sequential Windowed Acquisition Computer Program Product

In various embodiments, a computer program product includes a non-transitory and tangible computer-readable storage medium whose contents include a program with instructions being executed on a processor so as to perform a method for sequential windowed acquisition of mass spectrometry data. This method is performed by a system that includes one or more distinct software modules.

Figure 13:
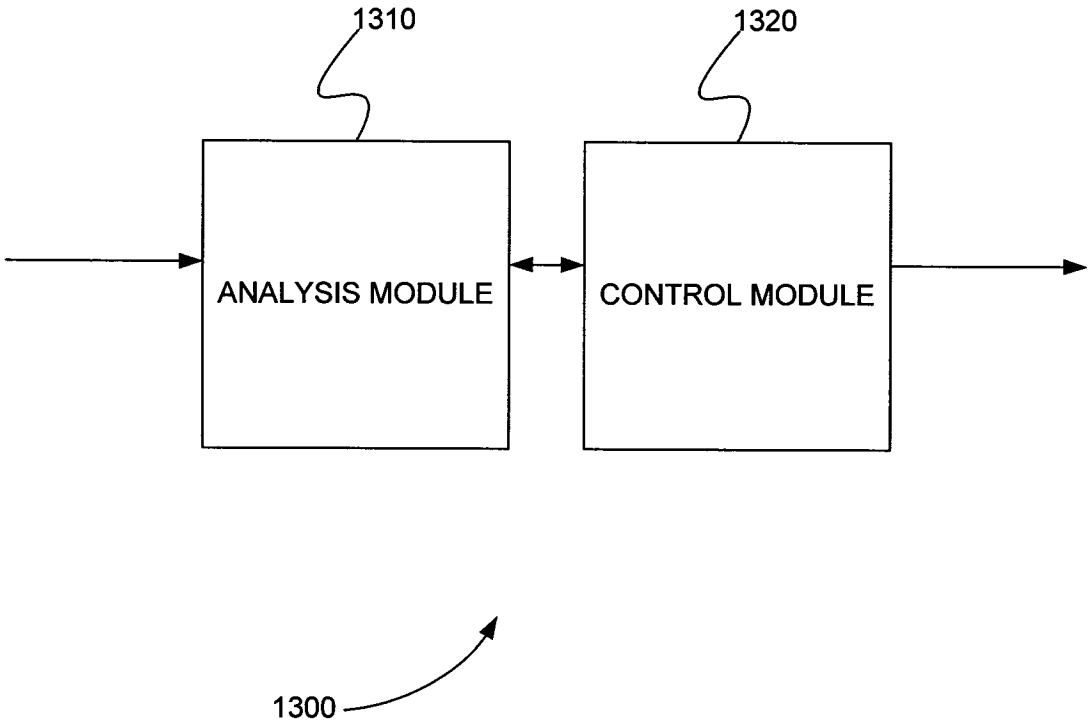
FIG. 13 is a schematic diagram of a system that includes one or more distinct software modules that perform a method for sequential windowed acquisition of mass spectrometry data, in accordance with various embodiments.

FIG. 13 is a schematic diagram of a system 1300 that includes one or more distinct software modules that perform a method for sequential windowed acquisition of mass spectrometry data, in accordance with various embodiments. System 1300 includes analysis module 1310 and control module 1320.

Analysis module 1310 receives a mass range and a mass window width parameter for a sample. Control module 1320 collects in an ion trap of a mass spectrometer a plurality of ions from the sample that are within the mass range. Analysis module 1310 calculates two or more adjacent or overlapping mass windows that span a mass range using the mass window width parameter. Control module 1320 ejects ions within each mass window of the two or more mass windows from the ion trap. Control module 1320 detects a mass spectrum from the ejected ions of the each mass window with a mass analyzer of the mass spectrometer producing a collection of mass spectra for the mass range.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for sequential windowed acquisition of mass spectrometry data, comprising:

a mass spectrometer that includes an ion source, a linear ion trap, and a mass analyzer; and a processor in communication with the mass spectrometer that receives a continuous mass range and a mass window width parameter for a sample, instructs the mass spectrometer to collect in the linear ion trap a plurality of ions from an ion beam that are within the continuous mass range, wherein the ion beam is produced by the ion source from the sample, instructs the mass spectrometer to apply a radio frequency (RF) radial excitation to the linear ion trap to select ions in the linear ion trap that are within the mass range and to apply an axial excitation to the linear ion trap to eject the selected ions within the mass range from the linear ion trap into the collision cell, instructs the mass spectrometer to turn off the ion beam from the sample to the linear ion trap, instructs the mass spectrometer to transfer back the selected ions within the mass range from the collision cell into the linear ion trap, calculates two or more adjacent or overlapping mass windows that span the continuous mass range using the mass window width parameter, instructs the mass spectrometer to apply an RF radial excitation to the linear ion trap to select ions in the linear ion trap within each mass window of the two or more adjacent or overlapping mass windows and to eject selected ions within each mass window of the two or more adjacent or overlapping mass windows from the linear ion trap into the collision cell using axial ejection, instructs the mass spectrometer to fragment using the collision cell ions within each mass window of the two or more adjacent or overlapping mass windows that are injected into the collision cell, instructs the mass spectrometer move the fragment ions of each mass window of the two or more adjacent or overlapping mass windows to the mass analyzer, and instructs the mass spectrometer to detect using the mass analyzer a mass spectrum for the fragment ions of each mass window of the two or more adjacent or overlapping mass windows that are moved into the mass analyzer, producing a collection of mass spectra for the continuous mass range, wherein the ions within each window of the two or more adjacent or overlapping mass windows are ejected to scan the continuous mass range.

2. The system of claim 1, wherein the two or more adjacent or overlapping mass windows have the same width.

3. The system of claim 2, wherein processor instructs the mass spectrometer to apply a radio frequency (RF) radial excitation to the linear ion trap to select ions within each mass window of the two or more adjacent or overlapping mass windows from the linear ion trap by using a different RF waveform with a different excitation frequency range for each mass window of the two or more adjacent or overlapping mass windows.

4. The system of claim 3, wherein a different RF waveform with a different excitation frequency range is calculated by the processor for each mass window of the two or more adjacent or overlapping mass windows and stored on the mass spectrometer before the mass spectrometer ejects any ions from the linear ion trap.

5. The system of claim 1, wherein the two or more adjacent or overlapping mass windows have different widths.

6. The system of claim 5, wherein processor instructs the mass spectrometer to apply a radio frequency (RF) radial excitation to the linear ion trap to select ions within each mass window of the two or more adjacent or overlapping mass windows from the ion trap by using the same RF waveform with the same excitation frequency range for each mass window of the two or more adjacent or overlapping mass windows.

7. The system of claim 5, wherein a width of each mass window of the two or more adjacent or overlapping mass windows increases with increasing mass of the each mass window in the continuous mass range.

8. The system of claim 1, wherein the processor instructs the mass spectrometer to select and eject ions within each mass window of the two or more adjacent or overlapping mass windows from the linear ion trap into the collision cell using radial amplitude assisted transfer (RAAT), wherein in RAAT a radial excitement field is used to select ions within each mass window and the selected ions are then ejected using an axial acceleration field.

9. The system of claim 1, wherein the processor instructs the mass spectrometer to select and eject ions within each mass window of the two or more adjacent or overlapping mass windows from the linear ion trap into the collision cell using mass selective axial ejection (MSAE), wherein in MSAE a radial excitement field is used to select ions within each mass window but an axial field is not used to eject the ions and instead the exit barrier between the linear ion trap and the collision cell is lowered to eject the ions of each mass window axially from the linear ion trap to the collision cell.

10. A method for sequential windowed acquisition of mass spectrometry data, comprising:

receiving a continuous mass range and a mass window width parameter for a sample;

collecting in an ion trap of a mass spectrometer a plurality of ions from an ion beam that are within the continuous mass range, wherein the ion beam is produced by an ion source from the sample;

applying a radio frequency (RF) radial excitation to a linear ion trap to select ions in the linear ion trap that are within the mass range and to apply an axial excitation to the linear ion trap to eject the selected ions within the mass range from the linear ion trap into the collision cell;

turning off the ion beam from the sample to the linear ion trap;

transferring back the selected ions within the mass range from the collision cell into the linear ion trap;

calculating two or more adjacent or overlapping mass windows that span the continuous mass range using the mass window width parameter;

applying an RF radial excitation to the linear ion trap to select ions in the linear ion trap within each mass window of the two or more adjacent or overlapping mass windows and ejecting selected ions within each mass window of the two or more adjacent or overlapping mass windows from the linear ion trap into the collision cell using axial ejection;

fragmenting using the collision cell ions within each mass window of the two or more adjacent or overlapping mass windows that are injected into the collision cell;

moving the fragment ions of each mass window of the two or more adjacent or overlapping mass windows to the mass analyzer; and detecting using a mass analyzer of the mass spectrometer a mass spectrum for the fragment ions of each mass window of the two or more adjacent or overlapping mass windows that are moved into the mass analyzer, producing a collection of mass spectra for the continuous mass range, wherein the ions within each window of the two or more adjacent or overlapping mass windows are ejected to scan the continuous mass range.

11. The method of claim 10, wherein the two or more adjacent or overlapping mass windows have the same width.

12. The method of claim 11, wherein applying a radio frequency (RF) radial excitation to the linear ion trap to select ions within each mass window of the two or more adjacent or overlapping mass windows from the ion trap comprises using a different RF waveform with a different excitation frequency range for each mass window of the two or more adjacent or overlapping mass windows.

13. The method of claim 12, further comprising calculating and storing on the mass spectrometer a different RF waveform with a different excitation frequency range for each mass window of the two or more adjacent or overlapping mass windows before the mass spectrometer ejects any ions from the ion trap.

14. The method of claim 10, wherein the two or more adjacent or overlapping mass windows have different widths.

15. The method of claim 14, wherein applying a radio frequency (RF) radial excitation to the linear ion trap to select ions within each mass window of the two or more adjacent or overlapping mass windows from the ion trap comprises using the same RF waveform with the same excitation frequency range for each mass window of the two or more adjacent or overlapping mass windows.

16. The method of claim 14, wherein a width of each mass window of the two or more adjacent or overlapping mass windows increases with increasing mass of the each mass window in the continuous mass range.

17. The method of claim 10, further comprising selecting and ejecting ions within each mass window of the two or more adjacent or overlapping mass windows from the linear ion trap into the collision cell using radial amplitude assisted transfer (RAAT), wherein in RAAT a radial excitement field is used to select ions within each mass window and the selected ions are then ejected using an axial acceleration field.

18. A non-transitory computer program product, comprising a non-transitory and tangible computer-readable storage medium whose contents include a program with instructions being executed on a processor so as to perform a method for sequential windowed acquisition of mass spectrometry data, the method comprising:

providing a system, wherein the system comprises one or more distinct software modules, and wherein the distinct software modules comprise an analysis module and a control module;

receiving a continuous mass range and a mass window width parameter for a sample using the analysis module;

collecting in an ion trap of a mass spectrometer a plurality of ions from an ion beam that are within the continuous mass range using the control module, wherein the ion beam is produced by an ion source from the sample;

applying a radio frequency (RF) radial excitation to a linear ion trap to select ions in the linear ion trap that are within the mass range and to apply an axial excitation to the linear ion trap to eject the selected ions within the mass range from the linear ion trap into the collision cell using the control module;

turning off the ion beam from the sample to the linear ion trap using the control module;

transferring back the selected ions within the mass range from the collision cell into the linear ion trap using the control module;

calculating two or more adjacent or overlapping mass windows that span the continuous mass range using the mass window width parameter using the analysis module;

applying an RF radial excitation to the linear ion trap to select ions in the linear ion trap within each mass window of the two or more adjacent or overlapping mass windows and ejecting selected ions within each mass window of the two or more adjacent or overlapping mass windows from the linear ion trap into the collision cell using axial ejection using the control module;

fragmenting using the collision cell ions within each mass window of the two or more adjacent or overlapping mass windows that are injected into the collision cell using the control module;

moving the fragment ions of each mass window of the two or more adjacent or overlapping mass windows to the mass analyzer using the control module; and detecting using a mass analyzer of the mass spectrometer a mass spectrum for the fragment ions of each mass window of the two or more adjacent or overlapping mass windows that are moved into the mass analyzer using the control module, producing a collection of mass spectra for the continuous mass range, wherein the ions within each window of the two or more adjacent or overlapping mass windows are ejected to scan the continuous mass range.

19. The non-transitory computer program product of claim 18, wherein the two or more adjacent or overlapping mass windows have the same width.

20. The non-transitory computer program product of claim 18, wherein the two or more adjacent or overlapping mass windows have different widths.

* * * * *